United States Patent [19]

Grabe et al.

[11] Patent Number: 4,915,034

[45] Date of Patent: Apr. 10, 1990

[54] TABLE SYSTEM

[75] Inventors: Rainer Grabe; Erich Becker, both of Springe, Fed. Rep. of Germany

[73] Assignee: Wilkhahn Wilkening & Hahne GmbH & Co. KG, Fed. Rep. of Germany

[21] Appl. No.: 92,947

[22] Filed: Sep. 4, 1987

[30] Foreign Application Priority Data

Oct. 16, 1986 [DE] Fed. Rep. of Germany ..... 3635288

[51] Int. Cl.[4] ..... A47B 1/00

[52] U.S. Cl. ..... 108/65; 108/64; 292/210

[58] Field of Search ..... 108/65, 114, 64, 89, 108/27; 248/345.1; 403/330, 316, 317, 300; 292/210

[56] References Cited

U.S. PATENT DOCUMENTS

| | | | |
|---|---|---|---|
| 225,541 | 3/1880 | Todd | 292/210 |
| 709,591 | 9/1902 | Bennett | 292/210 |
| 749,094 | 1/1904 | Quick et al. | 292/210 |
| 1,913,966 | 6/1933 | Walter | 108/89 |
| 2,031,398 | 2/1936 | Wagoner | 108/64 |
| 2,705,820 | 4/1955 | Torrence | 108/27 X |
| 2,857,223 | 10/1958 | Furey | 108/64 |
| 3,342,147 | 9/1967 | Shettles | 108/114 X |
| 4,165,908 | 8/1979 | Cooper et al. | 108/64 X |
| 4,591,289 | 5/1986 | Vickers et al. | 108/64 X |

FOREIGN PATENT DOCUMENTS

| | | | |
|---|---|---|---|
| 2100121 | 12/1982 | United Kingdom | 108/64 |

*Primary Examiner*—Peter A. Aschenbrenner
*Attorney, Agent, or Firm*—Learman & McCulloch

[57] ABSTRACT

The invention relates to a table system in which at least two adjacent table elements can be releasably connected via their opposing table top edges with the aid of at least one mechanical connecting arrangement. Of the essentially two-part connecting arrangement a first main part contains a retaining lever which is built into the table top edge region of one table element and can be pivoted outwards, whilst the second main part of the connecting arrangement, built into the table top edge region of the adjacent table element, is constructed so as to receive the retaining lever form-lockingly and contains a securing element for the locking engagement between the first and second main parts. The assembly and disconnection of the individual table elements can be carried out quickly and reliably without additional aids.

16 Claims, 3 Drawing Sheets

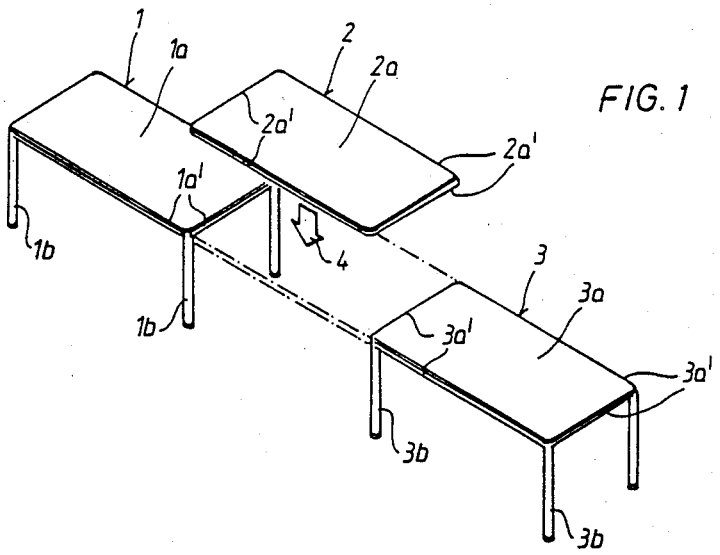
FIG. 1
FIG. 2
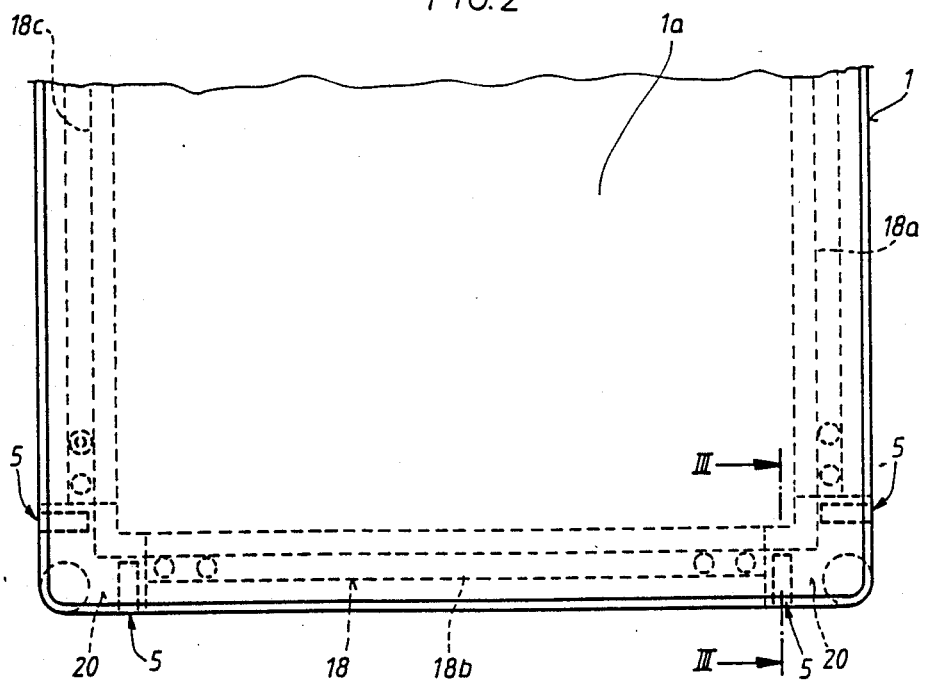

TABLE SYSTEM

The invention relates to a multiple unit wherein the individual units may be assembled with and disassembled from one another quickly and easily.

BACKGROUND OF THE INVENTION

For conference rooms, dining rooms and the like it is necessary time and again to assemble table systems in configurations which meet the particular requirements. The simplest forms of such table systems are those in which a plurality of individual, essentially similar tables are loosely assembled in the desired configuration. A significant disadvantage of loosely assembled tables it that individual tables can be easily displaced from the arrangement by comparatively slight contact.

Various table systems have therefore been developed in which the individual table elements (which can be individual free-standing tables and have so-called table top inserts) can be releasably connected to one another in the region of their opposing table top edges by means of mechanical connecting arrangements. One construction is known in the art in which hinges are fixed on the underside of the table top edges of table top inserts and the free hinge butts are folded outward during the assembly of the table top insert and the free-standing table and are releasably connected to the underside of the opposing table top edge of the table with the aid of appropriate fixing screws. This is extremely awkward and time-consuming and requires tools and loose fixing means.

A further construction is known in the art in which plug connection pieces are provided in the edge regions of the table tops which are to be connected to one another. In this case plug parts must be inserted horizontally into socket parts, which leads to awkward assembly of the table system for the required table configuration. In addition these connecting pieces are partially exposed and projecting so that they also hinder the stacking of unused tables to save space and can also cause scratching to the table tops during stacking or other handling. Furthermore, it has also be shown that it is not possible to achieve sufficiently reliable locking between the connecting pieces.

SUMMARY OF THE INVENTION

The object of the invention, therefore, is to produce a table system which permits fast and reliable connection of at least two table elements to one another with relatively simple construction and handling.

In contrast to the aforementioned known constructions, according to the invention one main part of each two-part connecting arrangement is built into the edge region of the table top of one table element and the second main part is built into the edge region of the table top of the adjacent other table element, i.e. the two main parts of the connecting arrangement can be fully integrated into the appertaining table top edge regions, so that when the individual table elements are not in use and are optionally stacked one on top of another they cannot be scratched by projecting connecting means or damaged in any other way. When the table elements of this table system according to the invention are to be assembled or connected to one another it is merely necessary for a retaining layer to be pivoted out of the outer contour of the appertaining table top edge from the first main part of the connecting arrangement so that the second main part which is built into the table top edge region of the adjacent other table element is placed on this retaining lever which engages form-lockingly in the second main part. This can be achieved by comparatively simple constructional means and result in simple and fast handling during the assembly of table elements. By the sensible construction of the two main parts of each connecting arrangement an extremely reliable locking engagement can be produced between these two main parts and thus between the adjacent table elements which are to be connected to one another, and this locking engagement can also be secured by a securing element provided on the second main part.

In spite of the easy releasibility of the main parts of each connecting arrangement, the table elements assembled in this way are connected to one another sufficiently firmly that for example a person leaning against a table element cannot cause any relative movement of these table elements. According to one embodiment of the invention it is also advantageous if the two main parts of the connecting arrangement (or of each connecting arrangement) are set into the table top edge of the appertaining table element from below and laterally and terminate flush with the external contour of the table top edge. This leads to a clean and aesthetically pleasing appearance of the table elements equipped with the main parts of the connecting arrangement.

It should be emphasized that the table elements can not only be tables which are adapted to one another, and preferably of similar construction, with straight table top edges, angular (preferably rectangular or square) and free-standing, but that these table elements can also be a combination of such angular tables with table top inserts (without legs), in which case a table top insert can be suspended between the table tops of two tables arranged a certain distance apart.

THE DRAWINGS

The invention will be explained in greater detail below with the aid of the drawings, in which:

FIG. 1 shows a perspective view of one embodiment of the table system according to the invention with three table elements;

FIG. 2 shows a plan view of the end of a rectangular table of this table system;

DETAILED DESCRIPTION

Figure 3:
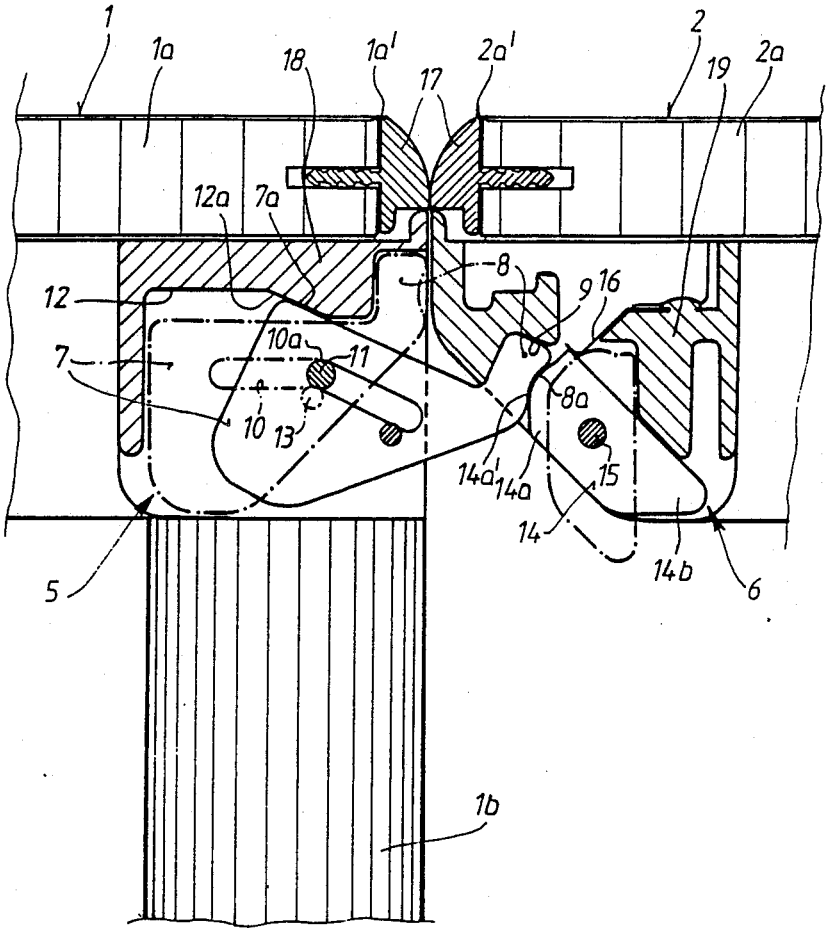
FIG. 3 shows a sectional view of a detail along the line III—III in FIG. 2 on an enlarged scale.

A preferred embodiment of the table system according to the invention is explained with the aid of FIG. 1. In this example three table elements are illustrated in perspective view, namely a first table element in the form of a free-standing rectangular table 1, a second table element in the form of an equally rectangular table top inset 2 and a third table element which is constructed in a similar manner to the first table element in the form of a rectangular table 3. Each of these three table elements 1, 2, 3 can have a rectangular table top 1*a*, 2*a* and 3*a* respectively of essentially similar construction with straight table top edges 1*a*′, 2*a*′ and 3*a*′ respectively, so that a common, essentially continuous table surface can be formed by connecting together the opposing edge regions of two table tops which are adjacent to one another (1*a* and 2*a* or 2*a* and 3*a*). For this purpose the tables 1 and 4 which are provided with table legs 1*b* and 3*b* respectively at their four corners are arranged—as shown in FIG. 1—an appropriate distance from one another so that the table top inset 2 whose essential part is the table top 2*a* can be inserted between their table tops 1*a* and 3*a*, and this table top insert 2 is moved (cf. the solid lines of the table top insert 2) downwards from above in the manner indicated in FIG. 1 according to the arrow 4 (cf. dash-dot lines) so that its table top 2*a* can be received between the table tops 1*a* and 3*a* of the two tables 1 ad 3 so as to fit accurately. The table elements 1 to 3 are then releasably connected to one another at their opposing edge regions with the aid of a mechanical connecting arrangement which will be explained in greater detail below.

It should be emphasized that any number of table elements (but at least two) can be connected to one another and that the individual table elements can basically be of any shape which is suitable for connecting table elements to one another forming a common table surface at their opposing edge regions. The latter can be achieved particularly successfully with table elements in which the table tops have straight edges, as is the case with four-cornered and particularly rectangular and trapezoid tables; however, it is also possible to use table shapes in which the table tops in plan view have approximately circular or elliptical sections with approximately straight end edges (connecting edges). It can be seen that in this way any table configuration can be put together in a great variety of ways from free-standing individual tables and table top inserts. Since these table elements are releasably connected to one another, they can be disconnected without problems after use and stored to save space and optionally transported.

In order for the adjacent table elements in this table system to be connected to one another easily, quickly and extremely reliably and to be disconnected equally simply when not in use, the mechanical connecting arrangements between the adjacent table tops are of particular importance.

The construction of these mechanical connecting arrangements will be explained in greater detail below with the aid of FIGS. 2 and 4. It should be assumed from the outset that a first main part of the essentially two-part connecting arrangement is built into the table top edge region of the illustrated table 1 near each corner in the manner shown in each case by broken lines at 5 in FIG. 2.

The basic construction of a connecting arrangement will be explained with the aid of FIG. 3, and it should be emphasized that all connecting arrangements on the table tops of this table system are of similar construction. In FIG. 3 it should be assumed that the illustrated mechanical connecting arrangement for releasable connection of the first table element 1 which is constructed as a rectangular table 1 and the second table element which is constructed as a table top insert 2 is provided in the region of the edges 1*a*′ and 2*a*′ respectively of the table tops 1*a* and 2*a*.

As has already been mentioned, each connecting arrangement consists essentially of two main parts. Of these two main parts of the connecting arrangement, the first main part 5 is—as already indicated in connection with FIG. 2—built into the region of the table top edge 1*a*′ of the table 1 (first table element) whilst the second main part 6 is built into the region of the opposing table top edge 2*a*′ of the table top 2*a* of the table top insert 2 (adjacent second table element).

The first main part 5 of the connecting arrangement contains a retaining lever 7 which can be pivoted out of the external contour of the table top edge 1*a*′ and is of plate-like construction with a retaining tab 8 projecting from one peripheral edge like a hook. This retaining tab 8 points substantially towards the second main part 6 of the connecting arrangement and in its projected position of the retaining lever 7 (shown by continuous lines in FIG. 3) engages in a suitable engaging recess 9 of corresponding shape in the second main part 6.

This retaining lever 7 has a slot 10 through which a stationary pin 11 passes so that a slot-pin connection is formed. With the aid of this slot-pin connection 10—11 the retaining lever 7 is retained pivotably in a shaped recess 12 in the first main part 5 in such a way that it is pivotable between an unretracted position (shown in FIG. 3 by dash-dot lines), in which it is fully received in the shaped recess 12 and the outer edge of its retaining tab 8 terminates flush with the external contour of the table top edge 1*a*′, and a projected position (shown in FIG. 3 in solid lines). In this engaged position a peripheral edge section 7*a* of the retaining plate 7 rests on an abutment surface 12*a* in the shaped recess 12. It can be seen in FIG. 3 that this abutment surface 12*a* lies roughly above the pin 11 and is inclined downwards in the direction of the second main part 6 of the connecting arrangement so that the retaining lever 7 can be held securely and stably in the outer engaged position when its peripheral edge section 7*a* rests on this abutment surface 12*a*. At one end 10*a* of the slot in the retaining lever 7, which receives the pin 11 in the retracted position of the said retaining lever 7, an elastic securing element in the form of an elastic loop 13 is arranged in such a way that the retaining lever 7 is stopped in its retracted position in co-operation with this pin 11. If the retaining lever 7 is then to be brought into its outer engaged position this catch can be released in a quite simple manner by exerting a manual pressure from below to rock this retaining lever 7.

The second main part 6 of the connecting arrangement, which—as mentioned—is built into the region of the table top edge 2*a*′ of the table top insert 2, is constructed particularly in its engaging recess 9 so as to receive the retaining tab 8 of the retaining lever 7 in a form-locking manner. As can be seen from FIG. 3, the retaining tab 8 is inclined substantially upwards in the engaged position of the retaining lever 7, whereas the corresponding engaging recess 9 of the second main part 6 of the connecting arrangement opens substantially downwards or inclined downwards. In this engaged position of the retaining plate 7 the retaining tab 8 projects beyond the external contour of the appertaining table top edge 1*a*′ to the extent that when this retaining tab 8 engages in the engaging recess 9 in the opposing second main part 6 the table top edges 1*a*′ and 2*a*′ which lie opposite one another and thus also the two adjacent table elements, that is to say the table 1 and the table top insert 2, are drawn close together.

The locking engagement thus produced between the first main part 5 and the second main part 6 is also secured in an advantageous manner by a securing element 14 which is arranged in the second main part 6. This securing element is preferably constructed in the form of a plate-shaped, two-armed rocking lever in which the upper part forms a securing portion and the lower part a control portion and which can be moved around a stationary turning pin between a secured position (shown in FIG. 3 by solid lines) and a released position (shown by dash-dot lines in FIG. 3). In the secured position the first lever arm 14a of the rocking lever 14 covers the engaging recess 9 on one side thereof and—with the retaining tab 8 received—can be brought into secure locking engagement with the retaining tab of the retaining lever 7, and the second lever arm 14*b* of this rocking lever 14 can then be pivoted flush with the appertaining table top 2*a*. The securing lever is automatically pivotted into the released position by the retaining tab. In the released position of this securing rocking lever 14 the first lever arm 14*a* is pivoted upwards and inwards away from the engaging recess 9 (as shown by dash-dot lines) and the second lever arm 14*b* then projects downwards from the appertaining table top 2*a* so that when the table top inset 2 and the table 1 are assembled together the engaging recess 9 of the second main part 6 is freely accessible for the introduction and engagement of the retaining tab 8 of the retaining lever 7 from below. After this engagement has been produced the securing rocking lever 14 can be brought back manually into its secured position (solid lines). It is advantageous if the edge section 8*a* of the retaining tab 8 lying opposite the first rocking lever arm 14*a* has a slight indentation 8*a* whilst the opposing end edge 14*a*' of this first rocking lever arm 14*a* has a matching rounded projection; these interengaging edge sections 8*a* and 14*a*' contribute to an increased reliability of the secured position of this rocking lever 14. It is also advantageous if a spring, for example a suitably shaped leaf spring 16, is also associated with this securing rocking lever 14, and the said spring acts for example on the peripheral edge of this first rocking lever arm 14*a* in such a way that the rocking lever 14 is stopped both in its secured position and in its released position but the pressure of the spring 16 can be easily overcome by manual pressure on one of the two rocking lever arms 14*a* or 14*b*.

It can also be seen in FIG. 3 that the two main parts 5, 6 of the connecting arrangement are set into the table top edges 1*a*' and 2*a*' of the appertaining table elements 1, 2 laterally from below and terminate substantially flush with the external contour of the table top edges.

In the representation according to FIG. 3 it is also shown that in the upper region of the table top edges 1*a*' and 2*a*' of the two table tops 1*a* and 2*a* of the table elements an elastic profile 17 which runs around the table edge is applied in such a way that it projects slightly with respect to the rest of the outer contour of these table top edges. It can also be seen that in the engaged position between the two main parts 5 and 6 of the connecting arrangement these table edge profiles are pressed elastically against one another and thereby act as sealing elements between the two table top edges 1*a*' and 2*a*' which are connected to one another (and pressed elastically against one another) and as a sort of tolerance buffer for the two main parts 5 and 6 of the locking arrangement. In addition these profiles running round the table edges provide a sort of protection for the exposed table top edges.

Before further details and advantageous embodiments of this table system and in particular of the connecting arrangements are gone into, a procedure for assembling the table top insert 2 and the table 1, that is to say two adjacent table elements, will be described with the aid of FIGS. 4 to 7. Since FIGS. 4 to 7 show simplified schematic representations of FIG. 3 (albeit in different assembly positions) the same reference numerals will be used here without going into the construction of the individual parts again.

Figure 4:
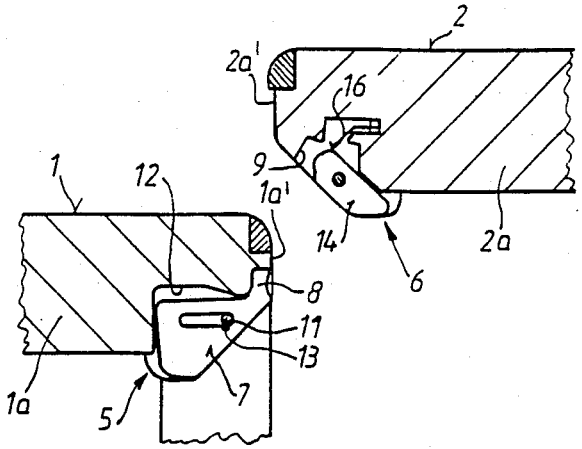
FIGS. 4 to 7 show simplified schematic partial cross-sectional views (similar to FIG. 3) in order to explain the assembly principle with the aid of four different assembly positions between two table elements which are to be connected to one another.

In the representation according to FIG. 4 the table 1 and the table top inset 2 are still completely separate from one another, the retaining lever 7 of the first main part 5 is in its retracted position and the securing rocking lever 14 is also in its retracted position which is at the same time the secured position. The retaining lever 7 is held in the retracted position by the engagement between the elastic loop 13 and the pin 11, whilst in the case of the securing rocking lever 14 the leaf spring 16 fulfils that function.

Figure 5:
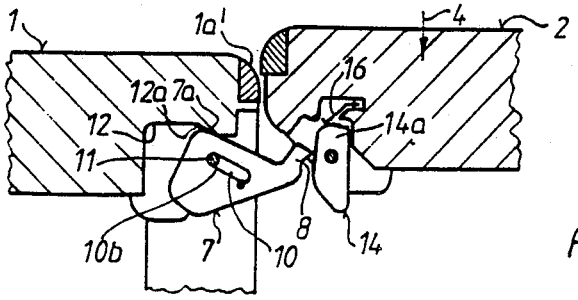

For the assembly of the table top insert 2 with the table 1 the retaining lever 7 is then brought from below by manual pressure into its outer engaged position, as shown in FIG. 5, so that its upper peripheral edge section 7*a* rests on the abutment surface 12a of the shaped recess 12 and the other end 10*b* of the slot 10 is held by the pin 11. The retaining tab 8—pointing at an angle upwards—projects a sufficient distance out of the outer contour of this table top edge 1*a*'. When the table top insert 2 is lowered further (arrow 4) the retaining tab 8 which has been pivoted outwards presses from below against the first lever arm 14*a* of the rocking lever 14 so that the latter is moved into its released position (FIG. 5) as described above after overcoming the force of the leaf spring 6.

Figure 6:
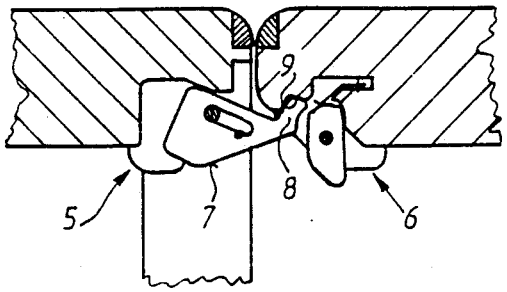
Figure 7:
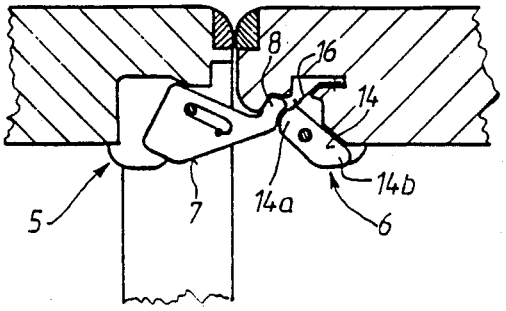

Having been pivoted outwards, the retaining tab 8 of the retaining lever 8 of the first main part of the connecting arrangement can now engage in a form-locking manner in the released engaging recess 9 in the second main part of the connecting arrangement, as shown in FIG. 6. Then a lateral manual pressure from below on the second rocking lever arm 14*b* brings the rocking lever 14 back into its secured position (the same as the retracted position) in which its first lever arm 14*a* comes into engagement with the retaining tab 8 of the retaining lever 7 in the manner described above and thus secures the locking engagement produced between the first main part 5 and the second main part 6 of the connecting arrangement against unintentional release, this rocking lever 14 being held in its secured position by the action of the leaf spring 16 on the first rocking lever arm 14*a*.

It should be clear from the assembly procedure described above with the aid of FIGS. 4 to 7 that such assembly of adjacent table elements can be carried out extremely quickly, reliably and permanently without any other aids or tools being necessary. With regard to the assembly of the table top insert 2 and the table 1 it should be added that when the table top insert 2 is lowered the elements of the connecting arrangement which are to be connected to one another center themselves to some extent through the engaging recess 9 which points downwards or at an angle downwards, largely under the table top insert's own weight, when the engaging recess 9 comes into engagement with the retaining tab 8. It goes without saying that in the fully assembled state of these table elements a level join between the two connected table tops 1 and 2 and thus a common, practically continuous table surface is ensured.

The table elements can be disassembled practically in the reverse sequence and just as quickly, easily and without problems as they are assembled as described above.

It also goes without saying that it is possible not only for free-standing tables and table top inserts to be connected together in the manner described above, but also that free-standing tables can be connected directly to one another in exactly the same manner and with the same connecting arrangements.

The connecting arrangements or the main parts thereof can be set and fixed directly into the edge regions of the appertaining table tops if the table tops are sufficiently thick and stable (rigid).

However, if the table top of a free-standing angular table is supported by a frame on which the table legs are also fixed at the corners, it is advantageous if—as indicated by broken lines in FIG. 2 and as shown in FIG. 3 in the case of the table 1—the frame 18 at the same time forms the table top edges 1*a* and one main part (the first main part 5 in the case of FIGS. 2 and 3) of each of two connecting arrangements is built into this frame 18 in the region of the corners of the table in each of the straight sides 18*a*, 18*b*, 18*c* of this frame 18. On the other hand, the other main part (the second main part 6 in the case of FIG. 3) of each of the two connecting arrangements on one side of the frame is built into the opposing table top edge 2*a*′ of the adjacent table element, i.e. the table top insert 2. This preferred use in each case of two connecting arrangements for the releasable connection of two adjacent table elements is generally sufficient and particularly reliable.

Any table top insert 2 can be constructed with a frame running round it which supports the appertaining table top 2*a*, just as in the case of the free standing tables 1 and 2. In the representation according to FIG. 3 it should therefore be assumed that the table top 2*a* of the table top insert 2 has an approximately similar frame 19 to that of the table top 1*a* of the table 1.

These frames 18 and 19 can be made from suitable finished metal profiles (preferably aluminium profiles) or also from wood.

If it is assumed that in the case of a plurality of free-standing tables 1, 3 these tables are always assembled together with table top inserts 2, then it is only necessary for first main parts 5 of the connecting arrangements to be built into the table top edges of each table and second main parts 6 to be built into the table top edges of each table top insert 2. If on the other hand it is also to be possible to connect free-standing tables, e.g. the tables 1 and 3, directly to one another, then only first main parts 5 of the connecting arrangements are built into one frame side 18*a* to 18*c* of each table 1, 3 and only second parts 6 are built into the other frame side 18*a* to 18*c* of each table.

There are also further embodiments of the construction of the connecting arrangements:

According to a first embodiment it should be assumed that—as indicated in FIG. 2—corner pieces 20 made from die castings are provided on the underside of the table tops, e.g. 1*a*, of the table elements, e.g. table 1, and are preferably built into the frame 18, whilst the retaining lever 7 (according to FIG. 3) of the first main part and the securing rocking lever 14 of the second main part 6 of each connecting arrangement are produced as shaped injection moulded parts. Then the shaped recesses 12 for the retaining lever 7 of the first main parts 5 and the engaging recesses 9 of the second parts 6 of the connecting arrangements are constructed or formed in the appertaining corner pieces 20. This construction should be readily understood by examining the illustrations in FIGS. 2 and 3.

A further possible construction for the connecting arrangements can also be explained with the aid of FIG. 3. According to this each connecting arrangement contains a first housing which is intended for the first main part 5 and in which the shaped recess 12 is constructed and the retaining lever 7 is pivotally received, as well as an equally box-shaped second housing which is intended for the second main part 6 and in which the engaging recess 9 is constructed and the securing rocking lever 14 is pivotably received. In this case the two housings, the retaining lever 7 and the securing rocking lever 14 of each connecting arrangement are produced as shaped castings, and the housings are set into the table top edge regions or frames of the appertaining table elements (free-standing tables 1, 3 and table top inserts 2) laterally from below.

No matter how the connecting arrangements are constructed, they each consist of a pair of main parts 5 and 6 which belong together.

It should be added that the table legs 1*b* and 3*b* are fixed at the corners of the free-standing tables 1, 3, and one preferred embodiment consists of providing the end pieces 20 referred to above with downwardly projecting threaded pins on which the upper ends of the table legs 1*b* and 3*b* which are provided with internal threads can be releasably screwed, so as to provide easy dismantling for storage and transport of these tables.

What is claimed is:

1. Table units adapted for separable connection to one another comprising a first table unit having a top surface; a second table unit having a top surface; first connecting means carried by one of said units at one side thereof and below the level of its top surface; and second connecting means carried by the other of said units at one side thereof and below the level of its top surface, said first and second table units being arranged so that said one side of one unit confronts said one side of the other unit, said first connecting means comprising a lever terminating at one end in a hook means mounting said lever on one of said units for sliding and pivoting movements along a path between retracted and projected positions relative to said one side of said one of said units, said mounting means including pivot means fixed to said one of said units about which said lever pivots, said first connecting means further including means for stablizing said lever against selected pivoting movement when said lever is in its projected position, said second connecting means having means forming a recess for the accommodation of said hook when said lever is in its projected position, and securing means carried by one of said units for releasably engaging said lever and locking said hook in said recess.

2. Table units according to claim 1 wherein said securing means is carried by said second unit.

3. Table units according to claim 1 wherein each of said table units has a side below its top surface, the respective connecting means being fitted into the side of the associated table unit and below its top surface.

4. Table units according to claim 1 including supporting legs joined to at least one of said table units for supporting the latter independently.

5. Table units according to claim 4 wherein the other of said table units is free of supporting legs.

6. Table units according to claim 1 wherein said first and second connecting means are carried by the respective table units in pairs.

7. Table units according to claim 1 wherein said securing means is carried by said second connecting means.

8. Table units according to claim 1 wherein said securing means is pivotable into and out of engagement with said lever.

9. Table units according to claim 1 including yieldable means carried by said one of said units for yieldably retaining said lever in its retracted position.

10. Table units according to claim 1 wherein said stablizing means comprises an abutment surface engageable with said lever.

11. Table units according to claim 1 wherein said securing means is movable from a locking position to a release position.

12. Table units according to claim 11 including resilient means carried by said other of said units for yieldably maintaining said securing means in its locking position.

13. Table units according to claim 11 wherein said securing means when in said locking position lies in the path of movement of said hook into said recess and is movable to said release position in response to engagement by said hook as the latter approaches said recess.

14. Table units according to claim 1 wherein each of said table units has an elastic profile at its top surface and extending laterally beyond said top surface a distance sufficient to engage the profile of the adjacent unit when said table units are connected together.

15. Apparatus for separably connecting two table units to one another comprising a pair of cooperable connecting means the first of which is adapted to be carried by one of said units and the second of which is adapted to be carried by the other of said units in a position confronting said first connecting means, said first connecting means comprising a lever having a free end terminating in a hook, means mounting said lever for reciprocating and pivoting movements along a path between retracted and projected positions, abutment means forming a part of said first connecting means for engagement with said lever in the projected position thereof to limit further pivoting thereof, said second connecting means having a recess for the accommodation of said hook when said lever is in its projected position, and releasable securing means carried by one of said connecting means for releasably securing said hook in said recess.

16. Apparatus according to claim 15 wherein said hook projects laterally of the direction of said path.

* * * * *

UNITED STATES PATENT AND TRADEMARK OFFICE

CERTIFICATE OF CORRECTION

PATENT NO. : 4,915,034

DATED : April 10, 1990

INVENTOR(S) : Grabe et al

It is certified that error appears in the above-identified patent and that said Letters Patent is hereby corrected as shown below:

In column 1, line 15, change "it" to -- is --;

In column 1, line 66, change "layer" to -- lever --;

In column 2, line 62, change "inset" to -- insert --;

In column 3, line 4, change "4" to -- 3 --;

In column 3, line 33, change "configuration" to -- configurations --;

In column 3, line 7, change "inset" to -- insert --;

In column 4, line 20, change "unretracted" to -- retracted --;

In column 8, line 6, change "pivotally" to -- pivotably --.

Signed and Sealed this

Eleventh Day of June, 1991

*Attest:*

*Attesting Officer*

HARRY F. MANBECK, JR.

*Commissioner of Patents and Trademarks*